United States Patent [19]

Richardson et al.

[11] Patent Number: 4,552,277

[45] Date of Patent: Nov. 12, 1985

[54] PROTECTIVE SHIELD DEVICE FOR USE WITH MEDICINE VIAL AND THE LIKE

[76] Inventors: Robert D. Richardson, 2202 Lakeland Rd., Anchorage, Ky. 40223; Thomas B. Leanhart, 1113 Girard Dr., Louisville, Ky. 40222

[21] Appl. No.: 616,572

[22] Filed: Jun. 4, 1984

[51] Int. Cl.[4] ..... B65D 81/32

[52] U.S. Cl. ..... 215/249; 215/6; 215/247; 604/411

[58] Field of Search ..... 215/249, 247, 248, 6; 206/219, 363; 220/85 B, 256; 604/283, 411, 414, 416, 905

[56] References Cited

U.S. PATENT DOCUMENTS

| | | | |
|---|---|---|---|
| 2,659,370 | 11/1953 | Smith | 215/6 X |
| 2,764,156 | 9/1956 | Simon et al. | 215/6 X |
| 3,198,194 | 8/1965 | Wilburn | 215/6 X |
| 3,467,097 | 9/1969 | Ogle | 215/6 X |
| 3,679,184 | 7/1972 | Woodham | 206/219 X |
| 3,696,919 | 10/1972 | Miles | 215/6 X |
| 3,902,489 | 9/1975 | Carter | 604/411 |
| 3,977,555 | 8/1976 | Larson | 215/247 |
| 4,274,543 | 6/1981 | Braymer, Jr. et al. | 215/249 X |
| 4,457,749 | 7/1984 | Bellotti | 604/411 X |
| 4,473,369 | 9/1984 | Lueders et al. | 604/411 X |

*Primary Examiner*—Steven M. Pollard
*Attorney, Agent, or Firm*—Jon C. Winger

[57] ABSTRACT

A shield device particularly useful in conjunction with a medicine containing vial or ampule to prevent medicine from spraying out of the vial as a hypodermic needle is extracted from the vial seal. The shield device includes a enclosure having a collapsable wall structure. One end of the shield device is formed with an opening for receiving the neck of the vial and sealing around the vial neck. The other end of the shield device from the vial neck receiving opening is formed with an aperture which is covered by a puncturable seal similar to the seal covering the opening into the vial neck. In use, the vial neck is inserted through the opening into the shield. Maintaining the shield device in the collapsed position with the shield seal in overlaying alignment with the vial seal, the needle of a hypodermic syringe is inserted through the shield seal and the vial seal, and into the vial for filling the vial with medicament or extracting medicament from the vial. The collapsed shield device is then manually extended to define a chamber. As the hypodermic needle is extracted, any medicine which may spray out of the vial through the puncture hole made in the vial seal by the hypodermic needle is captured in the shield chamber.

15 Claims, 8 Drawing Figures

PROTECTIVE SHIELD DEVICE FOR USE WITH MEDICINE VIAL AND THE LIKE

BACKGROUND OF THE INVENTION

The present invention is directed to a shield device for use in filling a hypodermic syringe from a vial and for use in transferring a medicament to a vial from the hypodermic syringe to protect the person using the hypodermic syringe. More particularly, the shield device relates to a collapsable shield device adapted to be easily attached medicament vial or ampule which creates a chamber for capturing any medicament spraying outwardly of the vial through the puncture hole in the vial seal as the hypodermic syringe needle is extracted from the vial seal.

Various attempts have been made to protect the person filling a hypodermic syringe from a medicament vial, and transferring medicament from the hypodermic syringe to a vial from contact with the medicament.

One such attempt is to provide a ventilation hood under which the medicament vial and hypodermic syringe is held while performing the operation of filling the hypodermic syringe or transferring medicament to the vial. The thought is that medicament spraying from the vial through the hypodermic needle puncture hole in the vial seal as the hypodermic needle is extracted from the vial seal will be removed by the ventilation hood before it contaminates the person using the hypodermic syringe.

Another attempt to protect the person using the hypodermic syringe is to provide a sealed box structure having hand receiving gloves attached thereto. The object is that the vial and hypodermic syringe are first placed into the box and the person inserts his hands into the gloves to manipulate the vial and hypodermic syringe in the box from the outside of the box. Medicament leaking from the vial through the puncture hole in the vial seal will, therefore, not contaminate the person using the hypodermic syringe.

Another attempt is shown in U.S. Pat. No. 3,993,063, issued on Nov. 23, 1976, which includes a complicated assembly of metal parts which entirely encloses the vial and the hypodermic syringe.

A further attempt is shown in U.S. Pat. No. 4,234,083, issued on Nov. 18, 1980, which requires a custom made or specially constructed vial.

Yet another attempt is shown in U.S. Pat. No. 3,882,909, issued on May 13, 1975, which includes a relatively complicated and, therefore, expensive to make fluid transfer device to be inserted into a vial which includes a parallel fluid passageways.

SUMMARY OF THE INVENTION

These prior art attempts to provide protection to a person using a hypodermic syringe in conjunction with a medicament vial have various drawbacks. They are expensive to manufacture. They are complicated to use. They must be cleaned after use. They are very time consuming to use and, therefore, in practice tend not to be used as intended.

The present invention recognizes the drawbacks of the prior art and provides a solution which obviates these drawbacks.

The present invention provides a shield for use in filling a hypodermic needle from a medicament vial or ampule, or transferring medicament from the hypodermic syringe to the vial which is easy to use.

The present invention also provides such a shield which is disposable.

The present invention further provides such a shield device which is inexpensive to manufacture.

More particularly, the present invention provides a shield adopted to be connected over the neck of a medicament vial or ampule comprising means defining a collapsable chamber, means defining an opening at one end of the chamber defining means adapted to receive and seal around the neck of the vial, means defining an aperture at the other end of the chamber defining means, and an imperforate puncturable seal closing the aperture of the chamber defining means, the seal being adapted to be punctured by a hypodermic syringe needle.

BRIEF DESCRIPTION OF THE DRAWINGS

The various features and advantages of the present invention will become more evident upon reading the following description in conjunction with the accompanying drawing in which like parts are identified by like numerals and wherein.

DETAILED DESCRIPTION OF THE PREFERRED EMBODIMENT

Figure 1:
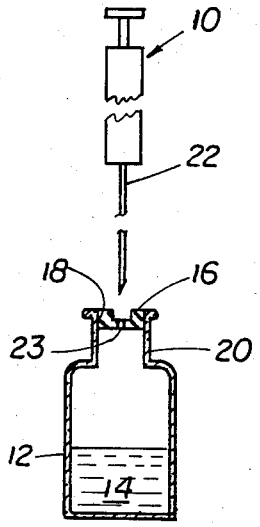
FIG. 1 illustrates the problem solved by the present invention.

FIG. 1 illustrates a problem which occurs when withdrawing a hypodermic syringe, generally denoted as the number 10, from a conventional or standard vial or ampule 12 containing a liquid medicament 14.

Typical medicament vials 12 have a puncturable elastomeric seal 16 closing the opening 18 into the vial 12 at the neck 20 of the vial 12 for closing the vial opening 18 and keeping the interior of the vial sterile. As the needle 22 of the hypodermic syringe 10 is withdrawn from the vial 12 through the vial seal 16 after it is filled with medicament from the vial or after medicament has been transferred from the hypodermic syringe to the vial, some medicament 14 tends to spray out of the vial through the puncture hole 23 made in the vial seal 16 by the needle 22 and into the ambient atmosphere as indicated by the arrows "A". This medicament can be harmful to persons in the area and particularly to the person manipulating the hypodermic syringe 10 and vial 12.

Figure 2:
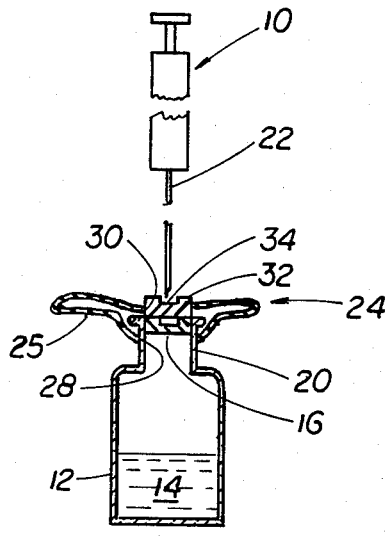
FIG. 2 illustrates one advantageous embodiment of the present invention attached to a medicament vial, and in a collapsed position.
Figure 3:
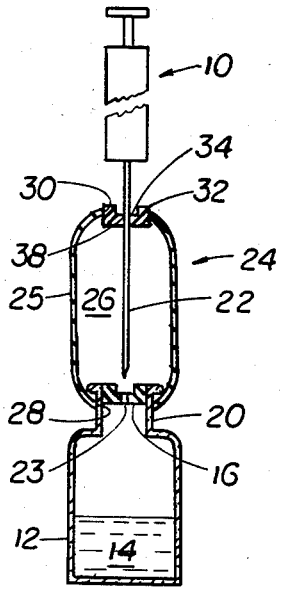
FIG. 3 illustrates the embodiment of FIG. 2 in an extended or expanded position.

Now with reference to FIGS. 2 and 3, there is shown a protective shield device of the present invention, generally denoted as the numeral 24. The protective shield device 24 is shown as a bag-like enclosure having a flexible collapsable wall structure 25. The wall 25 of the bag-like enclosure 24 can be fabricated of virtually any suitable, impermeable material such as a plastic, for example, polypropylene and the like which is somewhat elastic. The bag-like shield device 24 fits over the neck 20 of the vial 12 to define a chamber 26 open to the vial neck 20. Toward this end, the bag-like shield device 24 includes an opening 28 at one end thereof which is of a smaller diameter than the diameter of the vial neck 20, and which is adapted to receive the vial neck 20. Therefore, when the vial neck 20 is received through the opening 28, the material defining the opening 28 tightly embraces the perimeter of the vial neck 20 creating a seal therebetween. The opposite end of the bag-like shield device 24 is formed with an aperture 30 which is closed by a imperforate puncturable elastomeric seal 32 similar to the puncturable seal 16 closing the opening 18 in the vial neck 20. Typically, these seals 16 and 32 are of thinner construction near their central area to provide a diaphragm 34 adapted to be punctured by the hypodermic syring needle 22. The puncturable shield seal 32 can be held in place closing the aperture 30 through the bag-like shield device 24 by virtually any known means, for example, an adhesive, chemical welding or heat welding.

With reference to FIG. 2, after the vial neck 20 has been inserted through the opening 28 of the bag-like shield device 24, the bag-like shield 24 is maintained in a collapsed position with the puncturable seal 32 of the shield device 24 in aligned and overlaying relationship to the puncturable seal 16 closing the vial neck 20. The hypodermic syringe needle 22 is next aligned with the central area of the seal 32 of the shield 24 and forced longitudinally through the shield seal 32 and through the vial seal 16 into the interior of the vial 12.

With reference to FIG. 3, after the hypodermic syringe 10 has been either filled with medicament from the vial 12 or transferred medicament to the vial 12, the collapsed wall 25 of the shield device 24 is manually expanded to about the fullest extend thereby creating the chamber 26. In expanding the bag-like shield device 24, the hypodermic needle 22 is partially, but not necessarily totally extracted from the vial neck seal 16. Toward this end, the height of the expanded chamber 26 from the vial neck receiving opening 28 to the shield seal 32 can be limited to a dimension less than the length of the hypodermic needle 22 by suitable diminishing the expanded height of the wall structure 25. After the bag-like shield device 24 has been expanded, the hypodermic needle 22 is fully extracted from the vial neck seal 16. As the hypodermic needle 22 is withdrawn from the vial neck seal 16, any medicament 14 which sprays out of the puncture hole 25, as indicated by the arrows "A", will spray into the chamber 26 defined by the bag-like shield device 24, and will be captured therein. The hypodermic needle 22 is then extracted from the puncturable seal 32 of the bag-like shield device 24. Due to the low pressure within the chamber 26, medicament will not spray out through the puncture hole 38, made in the puncturable seal 32 by the hypodermic needle 22. Thus, the medicament is prevented from contaminating the ambient environment and particularly the person filling syringe 10.

Figure 4:
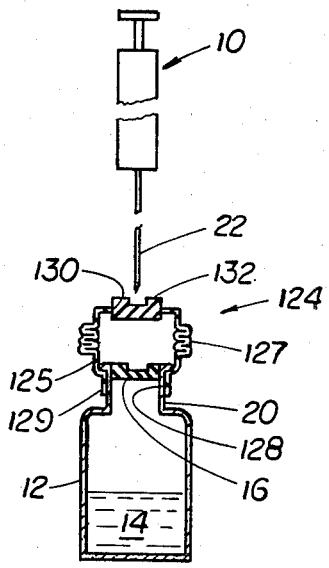
FIG. 4 illustrates another advantageous embodiment of the present invention to a medicament vial, and in a collapsed position.
Figure 5:
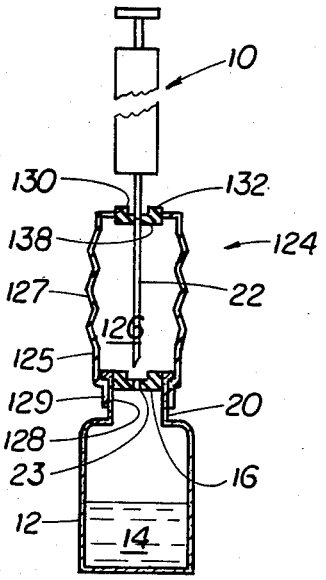
FIG. 5 illustrates the embodiment of FIG. 4 in an extended or expanded position.

FIGS. 4 and 5 illustrate another advantageous embodiment of the protective shield device of the present invention, generally denoted as the numeral 124. The protective shield 124 is shown as a somewhat tubular shaped enclosure having a collapsable wall structure 125 thicker than the wall structure 25 of the bag-like shield device 24. The tubular shield device 124 can be fabricated of virtually any suitable, impermeable material such as a plastic, for example, polypropylene or the like. The wall structure 125 of the tubular shield device 124 is formed with hinged sections such as, for example, accordion pleats 127 so that the tubular shield device 124 is collapsable. The tubular shield device 124 fits over the vial neck 20 to define a chamber 126 open to the vial neck 20. Toward this end, the tubular shield device 124 includes an opening 128 at one end thereof surrounded by a sealing ring 129 adapted to receive the vial neck 20 in sealing engagement. The opposite end of the tubular shield 124 is formed with an aperture 130 which is closed by a puncturable seal 132 similar to the vial neck seal 16.

With reference to FIG. 4, after the vial neck 20 has been inserted through the sealing ring 129 around the aperature 128 of the shield device 124, the shield device 124 is maintained in a collapsed position with the puncturable seal 132 of the shield in alignment overlaying relationship to the puncturable vial neck seal 16. The hypodermic syringe needle 22 is next aligned with the central area of the seal 132 of the shield 124 and forced longitudinally through the shield seal 132 and through the vial neck seal 16 into the interior of the vial 12.

Now referring to FIG. 5, after the hypodermic syringe 10 is then either filled with medicament 14 from the vial 12 or used to transfer medicament to the vial 12, the shield device 124 is manually expanded to about its fullest extend thereby creating the chamber 126. In expanding the shield device 124, the hypodermic needle 20 is at least partially extracted from the vial neck seal 16. After the shield 124 has been expanded, the hypodermic needle 22 is fully extracted from the vial neck seal 16. As the hypodermic needle 22 is withdrawn from the vial neck seal 16, any medicament 14 which sprays out of the puncture hole 23 in the vial neck seal made by the hypodermic needle 22, as indicated by the arrows "A", will spray into the chamber 126 defined by the expanded shield device 124, and will be captured therein. Due to the low pressure within the chamber 126, medicament will not spray out through the puncture hole 138 made in the shield seal 132 by the hypodermic needle 22 as the needle 22 is extracted from the shield seal 132.

Figure 6:
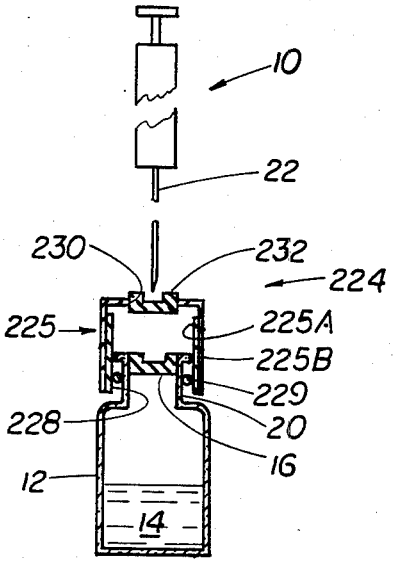
FIG. 6 illustrates a further advantageous embodiment of the present invention attached to a medicament vial, and in a collapsed position.
Figure 7:
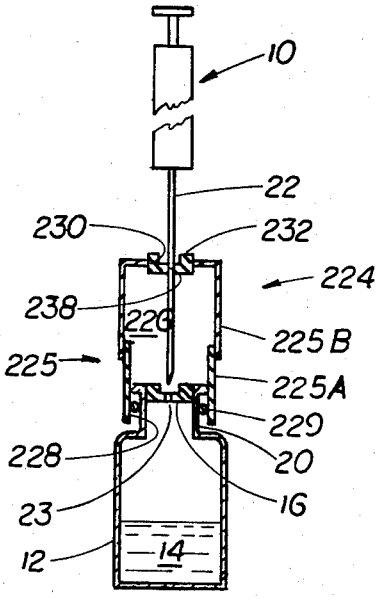
FIG. 7 illustrates the embodiment of FIG. 6 in an extended or expanded position; and, FIG. 8 is a perspective view of the embodiment of FIG. 4 in a stored position before being attached to the vial.

FIGS. 6 and 7 illustrate yet another advantageous embodiment of the protective shield of the present invention, generally denoted as the numeral 224. The protective shield 224 is shown as a cylindrically shaped enclosure having a collapsable telescoping wall structure 125 having a thickness greater than the tubular shield 124 of FIGS. 4 and 5. The telescopic wall structure 225 includes a bottom cylindrical section 225A adapted to be sealingly attached to the perimeter o the vial neck 20 an upper cylindrical section 225B coaxially received within the bottom section 225A for longitudinal movement therein from a collapsed position shown in FIG. 6 and an extended or expanded position shown in FIG. 7. The bottom end of the bottom cylindrical section 225A includes an opening 228 surrounded by a sealing ring 229 adapted to receive the vial neck 20 in sealing engagement. The top end of the upper cylindrical section 225B is formed with an aperture 230 which is closed by a puncturable seal 232 similar to the vial neck seal 16.

With reference to FIG. 6, after the vial neck 20 has been inserted through the sealing ring 229 around the opening 228 of the bottom cylindrical section 225A, the shield device 224 is maintained in the collapsed position with the puncturable seal 232 of the shield device 224 in aligned overlaying relationship to the puncturable vial neck seal 16. The hypodermic syringe needle 22 is next aligned with the central area of the seal 232 of the shield 224 and forced longitudinally through the shield seal 232 and through the vial neck seal 16 into the interior of the vial 12.

Now with reference to FIG. 7, after the hypodermic syringe 10 has either been filled with medicament from the vial or transferred medicament to the vial the shield device 224 is manually expanded by pulling the upper cylindrical wall section 225B longitudinally out of the bottom cylindrical wall section 225A to about its fullest extend thereby creating the chamber 226. In expanding the shield device 224, the hypodermic needle 22 is at least partially extracted from the vial neck seal 16. After the shield device 224 has been expanded, the hypodermic needle 22 is fully extracted from the vial neck seal 16. As the hypodermic needle 22 is withdrawn from the vial neck seal 16, any medicament 14 which sprays out of the puncture hole 23 of the vial neck seal 16, as indicated by the arrows "A", will spray into the chamber 226 defined by the expanded shield device 224, and will be captured therein. Due to the low pressure within the chamber 226, medicament will not spray out through the puncture hole 238 made in the shield seal 232 by the hypodermic needle 22 as the needle 22 is extracted from the shield seal 232.

Figure 8:
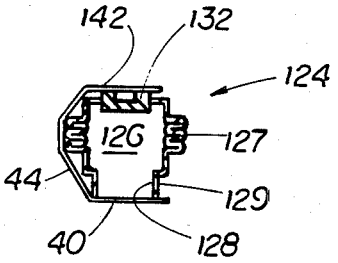

FIGS. 8 and 9 illustrate, by way of example, the embodiment of the FIGS. 4 and 5 in the collapsed position as they would packaged before use. The interior of the shield 124, i.e. the chamber 126, as well as the shield seal 132 is sterilized. A first removable strip seal 40 covers the opening 128 in the shield 124 to prevent the sterile chamber 126 from becoming contaminated before use. Another, or second removable strip seal 42 covers the sterile exterior surface of the shield seal 132 to maintain the shield seal 132 before use. The second strip seal 42 can also include a portion or length 44 extending down over the exterior surface of the collapsed shield wall structure 125 to maintain the shield 124 in the collapsed position. A contemplated construction is also to make the first strip seal 40 and second strip seal 42 of unitary construction by having the length 44 of the second seal 42 connected to the first seal 40. The first and second seals 40 and 42 are fastened in place by an adhesive having a low adhesive affinity so that the seals 40 and 42 can be conveniently removed from over the shield aperture 128, shield seal 132, and shield wall without leaving any residue.

The foregoing detailed description is given primarily for clearness of understanding and no unnecessary limitations are to be understood therefrom for modifications will become obvious to those skilled in the art upon reading this disclosure any may be made without departing from the scope of the appended claims and spirit of the invention.

What is claimed is:

1. A shield device adapted to be connected over the neck of a medicament vial and the like containing a liquid medicament, the vial being the type having a puncturable seal closing the vial neck adapted to be punctured by a hypodermic needle, the shield device comprising:

means defining a collapsable liquid medicament containing chamber adapted to receive and contain liquid medicament which may exit the vial through the puncture made in the vial seal upon withdrawal of the hypodermic needle from the vial seal;

means defining an opening at one end of the chamber defining means adapted to receive and seal around the neck of the vial;

means defining an aperture at the other end of the chamber defining means generally opposite the opening into the chamber defining means; and, an imperforate, puncturable seal device closing the aperture in the chamber defining means, the seal being adapted to be punctured by a hypodermic needle.

2. The shield device of claim 1, wherein the chamber defining means comprises a wall structure fabricated of a flexible material.

3. The shield device of claim 2, wherein the flexible material is elastic.

4. The shield device of claim 3, wherein the vial neck receiving opening is formed in the wall structure.

5. The shield device of claim 1, wherein when the chamber defining means if collapsed, the distance between the seal device and the vial neck receiving opening is less than the length of the hypodermic syringe needle; and when the chamber defining means is extended, the distance between the seal device and the vial neck receiving opening is greater than the length of the hypodermic syringe needle.

6. The shield device of claim 1, wherein the chamber defining means comprises a collapsable wall structure having foldable pleats formed therein.

7. The shield device of claim 6, wherein the chamber defining walls define a generally cylindrical enclosure.

8. The shield device of claim 6, wherein the wall structure is fabricated of a flexible material.

9. The shield device of claim 6, wherein the wall structure is fabricated of a flexible, elastic material.

10. The shield device of claim 9, wherein the vial neck receiving opening is formed in the wall structure.

11. The shield device of claim 1, further comprising a seal ring associated with the opening defining means adapted to sealingly engage the perimeter of the vial neck.

12. The shield device of claim 1, wherein the means defining the collapsable chamber comprises:

a first generally cylindrical walled section; and, a second generally cylindrical walled section slidably received within the first section for relative telescopic motion therewith.

13. The shield device of claim 12, wherein:

the opening defining means adapted to receive and seal around the vial neck is located at the exposed end of one of the cylindrical walled sections; and, the aperture defining means closed by the seal device is located at the exposed end of the other cylindrical walled section.

14. The shield device of claim 13, wherein the first and second generally walled sections are fabricated of a relatively rigid material.

15. The shield device of claim 12, further comprising a sealing ring associated with the opening defining means adapted to sealingly engage the perimeter of the vial neck.

* * * * *